US005445713A

United States Patent [19]

Kunihisa et al.

[11] Patent Number: 5,445,713

[45] Date of Patent: Aug. 29, 1995

[54] APPARATUS FOR USE IN MAKING MULTILAYERED PAPER

[75] Inventors: Kazuo Kunihisa; Hiroto Shimazu; Takashi Bando, all of Hiroshima; Masateru Tokuno, Tokyo, all of Japan

[73] Assignees: Mitsubishi Jukogyo Kabushiki Kaisha; SK Engineering Co., Ltd., both of Tokyo, Japan

[21] Appl. No.: 118,331

[22] Filed: Sep. 9, 1993

[30] Foreign Application Priority Data

Jan. 14, 1993 [JP] Japan ..... 5-020823

[51] Int. Cl.[6] ..... D21F 1/00

[52] U.S. Cl. ..... 162/304; 162/133; 162/273

[58] Field of Search ..... 162/133, 273, 274, 303, 162/304

[56] References Cited

U.S. PATENT DOCUMENTS

| | | | |
|---|---|---|---|
| 3,573,162 | 3/1971 | Brezeinski | 162/303 |
| 3,989,587 | 11/1976 | Grossman | 162/304 |
| 4,004,968 | 1/1977 | Braun et al. | 162/304 |
| 4,153,504 | 5/1979 | Justus | 162/304 |
| 4,154,645 | 5/1979 | Kankaanpaa | 162/304 |

FOREIGN PATENT DOCUMENTS

| | | | |
|---|---|---|---|
| 30768 | 7/1960 | Finland | 162/304 |
| 1808403 | 7/1969 | Germany . | |
| 2041030 | 9/1980 | United Kingdom | 162/304 |

*Primary Examiner*—Karen M. Hastings
*Attorney, Agent, or Firm*—Wenderoth, Lind & Ponack

[57] ABSTRACT

Apparatus for forming multilayered paper includes an endless loop of felt and at least two short wire units provided beneath the loop of felt. Each short wire unit has a fixed dehydrator having a forming shoe, at least part of the upper surface of which is curved, and a short wire traveling over the curved part of the upper surface of the forming shoe. The endless loop of felt is engaged with the short wire on the curved upper surfaces of the forming shoes of the fixed dehydrators. Stock is ejected from a head box onto each short wire unit and is moved between the endless loop of felt and the short wire of the unit where the stock is dehydrated to thereby form a paper layer. Each of a forming roll and a couch roll guiding the felt into engagement with the short wire, and a felt roll disposed beneath the felt downstream of the short wire unit, can be moved vertically. By raising the felt with the felt roll and moving the forming and couch rolls vertically, the short wire and the endless loop of felt can be disengaged. Therefore, the short wires can be easily replaced.

3 Claims, 4 Drawing Sheets

APPARATUS FOR USE IN MAKING MULTILAYERED PAPER

BACKGROUND OF THE INVENTION

1. Field of the Invention

The present invention relates to an apparatus for use in forming multilayered paper in a paper making machine.

2. Description of the Related Art

FIG. 3 shows an example of a prior art device for use in forming multilayered paper. The device shown in FIG. 3 is located at the end of a wet part of a typical paper making machine. Paper stock ejected from a head box 20 is dehydrated on a table unit 22 located within the loop of a short wire 21. A paper layer is formed on the short wire 21 when the stock is further dehydrated by pressing the stock with felt 19 pressed against a forming cylinder 24. A paper layer formed by each upstream unit U and the paper layer(s) formed by the downstream unit(s) D are bonded to each other on the forming cylinder 24 of the downstream unit by being pressed with a coacting roll 25. The white water spouting from the forming cylinder 24 when the short wire 21 is separated from the forming cylinder 24 is drawn out by a suction slider 26. On the other hand, the paper layers bonded on the forming cylinder 24 are shifted to the felt 19 by a suction pick-up 29 so as to be fed to the next (downstream) unit.

FIG. 4 shows another example of a prior art device for use in forming multilayered paper. This device is a typical part of paper making machine which combine layers of paper by using short wires and a Fourdrinier wire. In FIG. 4, paper stock ejected from a head box 30 is formed into a paper layer by being dehydrated on a table unit 33 disposed within the loop of a Fourdrinier wire 32. In addition, paper stock ejected from a head box 31 lands on the paper layer already formed and enters into a gap formed by a short wire 34 engaged with a lead-in box 40 of the Fourdrinier wire. In the portion where the short wire coacts with the Fourdrinier wire, the stock from the head box 31 is concurrently formed into a paper layer and combined with the already formed paper layer by being dehydrated in an upward direction due to tension in the short wire in pressing engagement with the lead-in box 40 and a vacuum produced at a vacuum dehydrator 39.

After that, the combined paper layers are shifted solely to the Fourdrinier wire 32 by the vacuum created by a transfer box 41 whereupon the combined paper layers are transferred to a downstream short wire 45. In order to increase the density of the combined paper layers, a vacuum box 42 is provided within the loop of the Fourdrinier wire. Paper comprising the paper layers thus combined is picked up by a suction pick-up roll 44 downstream of a suction couch roll 43 and is subjected to a subsequent process.

The multilayered paper is not sufficiently formed by the device shown in FIG. 3 because the initial paper layer was formed by a table unit 22 (such as a forming board, foil, table roll and a wet suction box of the type known for use in a paper making machine employing the Fourdrinier wire and cylinder mold) and the paper layers are dehydrated by forming cylinders 24.

In addition, in this prior art device, the wet mat can be crushed due to the difficulty in taking the wet paper into the forming cylinder at a high speed. This problem becomes more severe as the wet paper consistency decrease with increases in the amount of stock per layer on the short wire. Accordingly, the amount of stock per layer in the short wire cannot be increased without risking the problem of the wet mat being crushed at the forming cylinder. Further, the device shown in FIG. 3 is intended to facilitate white water treatment. However, there are problems created by the spattering of mist. Further, the white water in the cylinder mold is difficult to treat because the felt travels over the forming cylinder 24.

Replacement of the felt 19 in this prior art device is difficult because the loop formed by the felt is complicated due to the fact that the felt 19 is Wrapped around portions of a plurality of short wires 21. Accordingly, sometimes felt having a seam (similar to that of drawing canvas) is used, and a mark on the paper can occur when the seam arrives at the coacting roll 25.

Further, in the device for forming multilayered paper shown in FIG. 3, the bonding strength of the wet mat decreases as the dehydrating capacity of the short wire table is increased which raises the wet paper density.

In the prior art device for use in forming multilayered paper shown in FIG. 4, a high level of vacuum is required to suction the white water upwardly against gravity and to discharge the white water from the autoslice provided in the vacuum dehydrator. Because the white water always fills the vacuum dehydrator 39, an even greater level of vacuum was required for discharging the white water and dehydrating the stock in the two wires through the white water. In addition, because the short wires 34, 45 are pressed forcefully on the forming shoe (not shown) of the vacuum dehydrators 39 by the high level of vacuum, a large amount of power was required to drive the short wires.

With respect to the ability to operate a low speed and to make high weight paper, the prior art device of FIG. 4 is better than that of the prior art device of FIG. 3 because the radius of curvature at the lead-in box in FIG. 4 is larger than that at the forming cylinder in FIG. 3. However, there are still some problems in leading the wet paper layer into the short wire units at a very low speed in the prior art device of FIG. 4. Therefore, it is necessary to use a relatively large amount of stock per layer.

Further, in the short wire units in the prior art device of FIG. 4, treating the white water from the short wire 34 is difficult and measures are required for preventing the mist generated from spattering, because the short wire units are provided on the Fourdrinier wire.

SUMMARY OF THE INVENTION

Objects of the present invention are to solve the above-described problems in the prior art.

To achieve these objects, the present invention provides an apparatus for use in forming multilayered paper characterized in that a plurality of short wire units are disposed beneath an endless loop of felt, fixed dehydrators including a forming shoe having an upper curved surface are disposed within the short wires of the short wire units, respectively, and the endless loop of felt is in pressing engagement with each of the short wires of the short wire units along the curved surface of each of the fixed dehydrators. In addition, the fixed dehydrators can take the form of a suction box having a housing connected to a vacuum source such that a vacuum is used to accelerate the dehydration of the stock by the forming shoes of the dehydrators. Paper layers are formed by dehydrating the stock ejected onto each of the short wires and moving the stock between the endless loop of felt and the short wires.

More specifically, stock is ejected from a head box into a gap defined between the endless loop of felt and a short wire unit. The stock is first dehydrated due to a foil effect created by the blades of the forming shoe at a part of the short wire unit where the endless loop of felt does not engage the short wire. This part is typically over the first half of the forming shoe of the fixed dehydrator in the direction of travel of the stock. The stock next enters the nip between the short wire and the endless loop of felt and dehydration of the stock is accelerated by dispersing the fibers with pressure pulses induced by the blades of the forming shoe against which shoe the stock is forcefully pressed by the endless loop of felt. By lifting a felt roll, and changing the vertical positions of a forming roll and a couch roll of a short wire unit, the short wire and the endless loop of felt can be disengaged. Accordingly, it is possible to use only the minimum number of necessary units in accordance with the weight of the paper to be produced, and the short wire in a unit which is stopped can be easily replaced.

DETAILED DESCRIPTION OF THE PREFERRED EMBODIMENTS

A plurality of head boxes 1 and short wire units are provided along the direction of travel of but beneath an endless loop 5 of felt.

Figure 2:
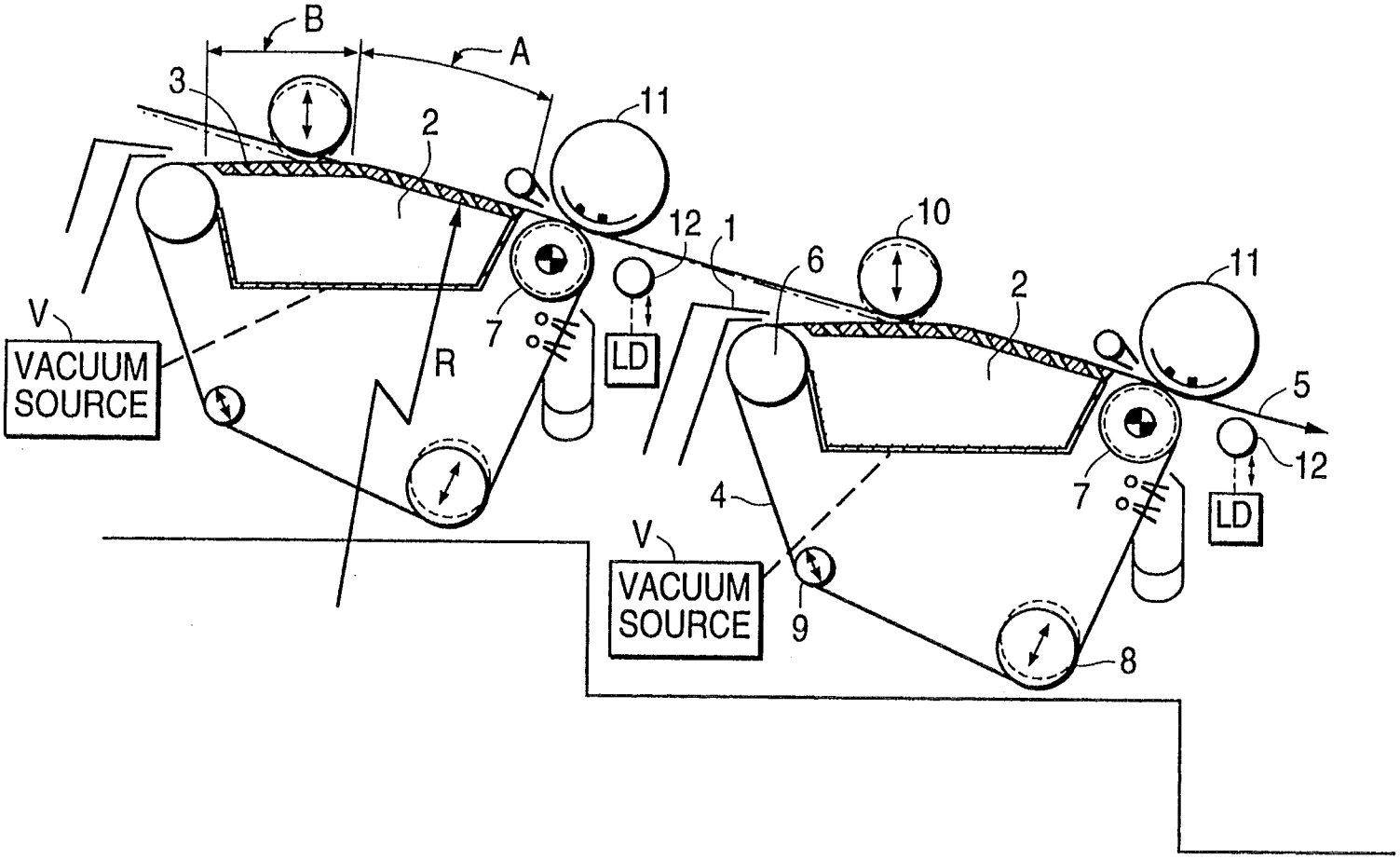
FIG. 2 is a detailed diagram of a major part of the apparatus shown in FIG. 1.
Figure 3:
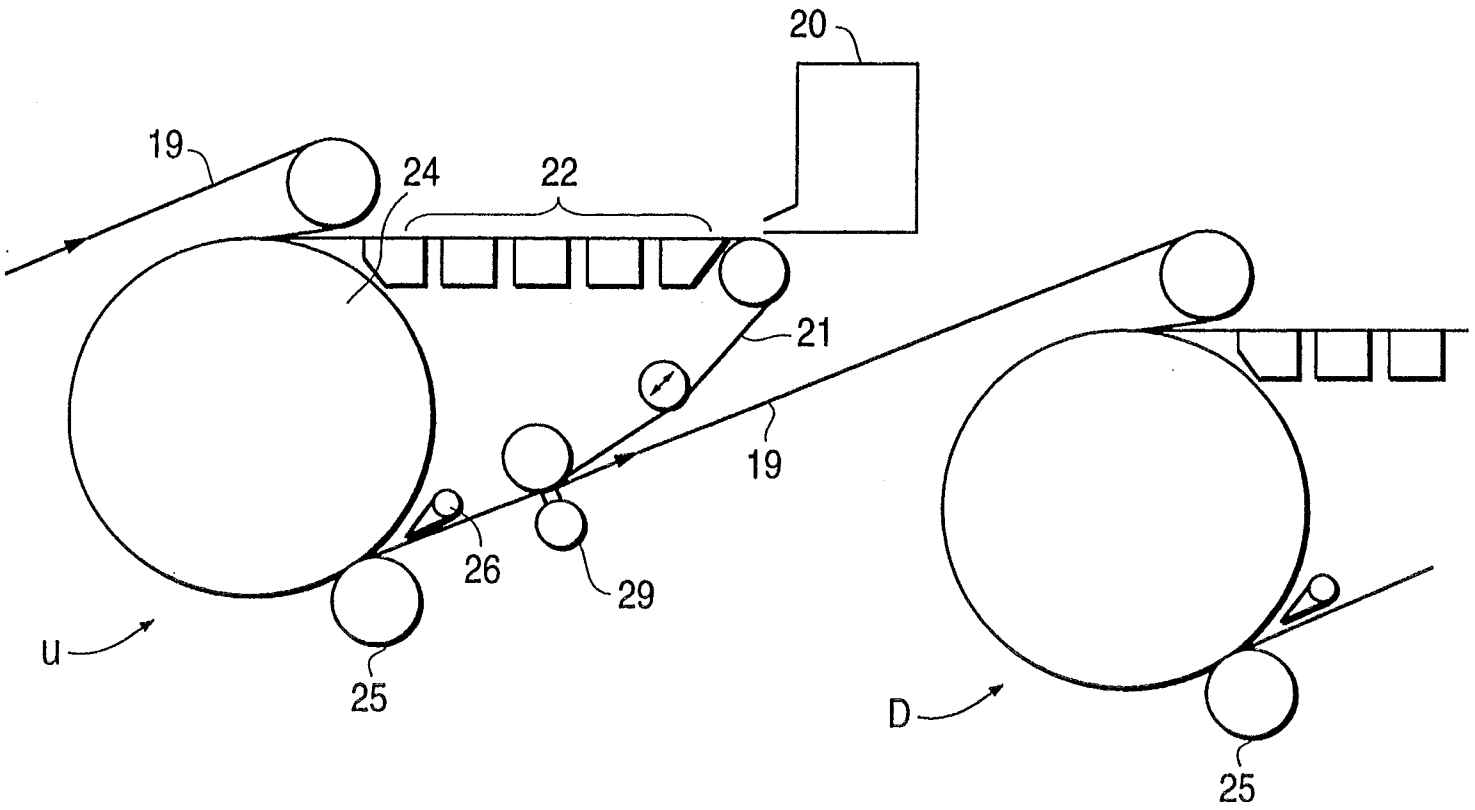
FIG. 3 PRIOR ART
FIG. 3 is a schematic diagram of a prior art device for forming multilayered paper.

Each short wire unit, as best shown in FIG. 2, includes a short wire 4, and a fixed dehydrator 2 having a forming shoe 3 comprising a plurality of forming blades, and also includes a breast roll 6, a drive roll 7, a tensioning roll 8, and a guide roll 9 around which the short wire 4 is wrapped. The short wire 4 moves over the fixed dehydrator 2 in contact with respective surfaces of the blades of the forming shoe 3. The blades of the forming shoes 3 may be of a fixed type constituting a unitary part of the dehydrator 2 or they may be supported so as to be able to be extracted from and inserted into the dehydrator as desired. That is, the blades of the forming shoe 3 may be of an insert type (not shown in the figure) in which the type (shape) and the number of blades can be changed as necessary.

Each dehydrator 2 is located beneath the endless loop 5 of felt. An upstream half (B) of the forming shoe 3 of the dehydrator 2 is out of pressing engagement with the endless loop 5 of felt. The endless loop 5 of felt is urged by the forming roll 10 into pressing engagement with each dehydrator 2 beginning at a respective midpoint of the dehydrator with respect to the direction of travel of the endless loop 5. Although the fixed dehydrator 2 may comprise a plurality of discrete portions, the portion (A) of the forming shoe 3 in pressing engagement with the endless loop 5 of felt is to have a larger radius of curvature than the other portion (B) out of engagement with the loop 5. Alternatively, the portion (B) of the forming shoe 3 of the dehydrator 2 near the head box 1 may have a flat upper surface while the other portion (A) has a curved surface.

It is possible to increase the dehydrating pressure with an increase in wet paper density by making the radii of curvature of the surfaces over which the endless loop 5 of felt travels successively smaller in the direction of travel of the endless loop 5 of felt. In addition, the fixed dehydrator 2 may include a suction housing connected to a vacuum source (V) for reasons to be described later.

In operation, stock is ejected from each head box 1 onto a respective short wire 4 between the breast roll 6 and the forming roll 10 of the short wire unit. The stock enters into a nip between the endless loop 5 of felt and the short wire 4 after being dehydrated by a foil effect produced by the blades of the forming shoe 3 at the part (e.g. first half) of the forming shoe 3 of the fixed dehydrator 2 out of engagement with the loop 5. If the radius of curvature R of the curved surface of the forming shoe (portion A) of the fixed dehydrator 2 is made large enough, the pressure exerted on the stock in its direction of travel by the endless loop 5 of felt is small enough for the stock to be introduced into the nip without problems. Needless to say, the relative position at which the stock is taken into the nip can be optimized by adjusting the forming roll 10, provided in the endless loop 5 of felt, vertically as shown by the arrow in FIG. 2, whereby various thicknesses of stock can be accommodated.

Because the forming shoe 3 of the fixed dehydrator 2 comprises a plurality of blades, a paper layer is well formed at portion (A) of the forming shoe 3 by accelerating dehydration of the stock by dispersing the fibers of the stock under a shearing force induced by a pressure pulse generated at each blade. If the forming shoe 3 is of the insert type described above, the level of the pressure and the number of pulses can be adjusted. With such an insert type of forming shoe, fine adjustments in the formation of the paper layer can be made.

Because the radius of curvature of the surface defined by the upper surfaces of the blades of the forming shoe 3 of the fixed dehydrator 2 decreases gradually in the downstream direction (direction of travel of loop 5), the pressure which dehydrates the stock will increase accompanied by increases in the density of the stock.

In addition, treatment of the white water is facilitated because the short wire units are located beneath the endless loop 5 of felt.

Figure 4:
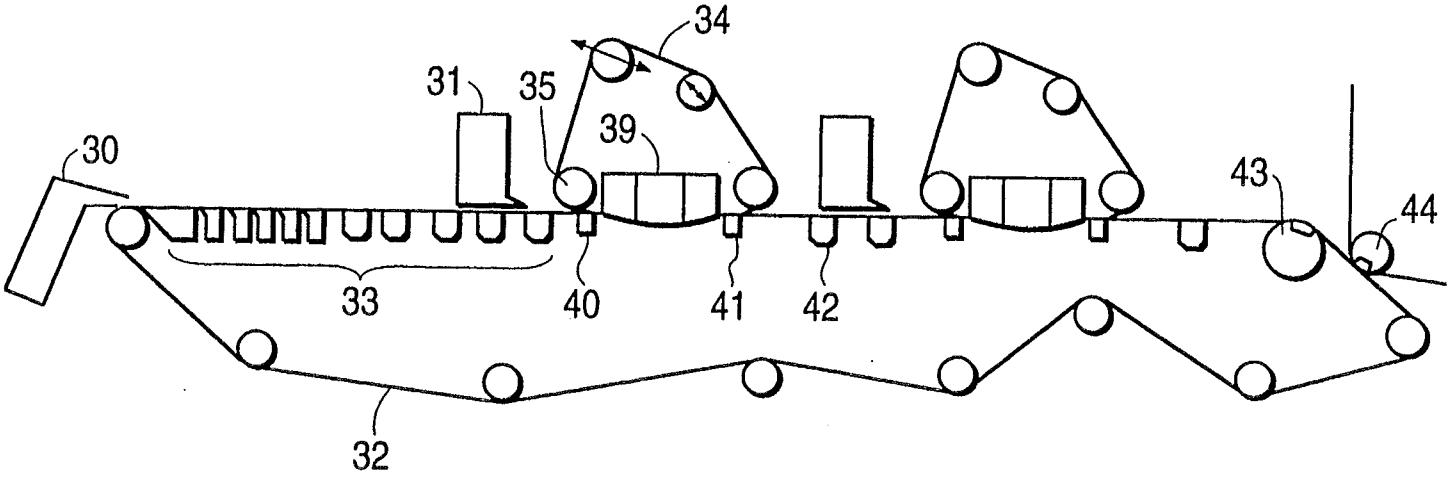
FIG. 4 PRIOR ART
FIG. 4 is a schematic diagram of another prior art device for forming multilayered paper.

Because the fixed dehydrator 2 has a housing of the same structure as that of a typical suction box, the dehydration of the stock can be enhanced by creating a low degree of vacuum within the dehydrator 2. Further, all of the dehydrating is conducted in a downward direction by the fixed dehydrator 2, unlike the vacuum dehydrator 39 of the prior art device of FIG. 4. Thus, the vacuum required and the power for driving the short wire are comparatively less than in the prior art.

The paper layer formed on the short wire 4 is bonded to the wet paper on the loop 5 by biasing the couch roll 11 toward the drive roll 7. The thus bonded paper layer is transferred to a downstream short wire unit. In order to ensure the transfer of the paper layer to the loop of felt upon combining all of the layers which are to make up the multilayered paper, the cough roll of the downstream short wire unit is in the form of a suction couch roll 11' (FIG. 1).

Figure 1:
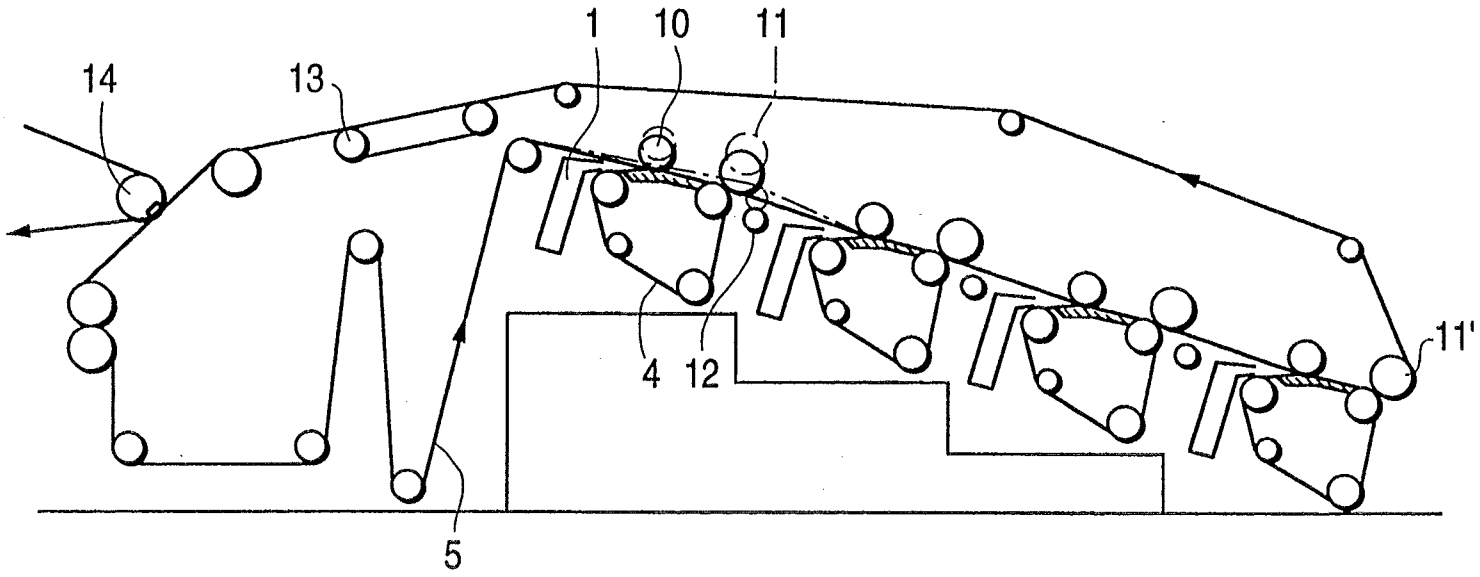
FIG. 1 is a schematic diagram of an apparatus for forming multilayered paper in a paper making machine according to the present invention.

FIG. 1 shows the present invention as applied to the end of a wet part of a paper making machine which transfers the adhered layers of the wet paper to a press part of the machine. In this case, each of the paper layers is formed at a short wire unit. The multilayered paper is transferred from the last (downstream) short wire unit shown in FIG. 1 onto the endless loop 5 of felt by the suction couch roll 11'. The density of the wet paper is increased by dehydrating the paper with a flow back device 13, known per se, and provided within the endless loop 5 of the felt. The multilayered paper is then picked up by a suction pick-up roll 14 to transfer the paper for subsequent processing.

As mentioned above, the forming roll 10 and the couch roll 11 are supported in any known way to bias the endless loop 5 of felt into engagement with the short wire 4. Each of the forming roll 10 and the couch roll 11 is allowed to be moved vertically. The felt roll 12 disposed downstream of the short wire unit is connected to a lifting device (LD) illustrated schematically. The lifting device can be of any of various well known devices apable of moving a roll while allowing it to remain supported for rotation. The short wire 4 can be disengaged from the felt by moving the forming roll 10, the couch roll 11 and the felt roll 12 upwardly by lifting the felt roll 12 into contact with the felt 5 and lifting the felt, as shown by the chain lines in FIG. 1. In this way, not only can a certain number of the short wire units be rendered ineffective, but the short wires of the non-operating units can be stopped and easily replaced.

As described in detail, according to the present invention, each layer is well-formed because it was dehydrated by pressure pulses induced by the blades of the forming shoe to thereby disperse its fibers. This dispersion raises the bonding strength between respective layers as well as between the wet and dry portions of the stock produced during the formation of each layer itself (adhesion method of forming a paper layer). Because the fixed dehydrator can subject the stock to a vacuum, the weight of the paper layer produced per short wire unit can be made high regardless of the wire speed. The apparatus thus requires a small installation area, is low cost, and can employ a relatively few number of units even when it is to effect a high speed operation. Further, the necessary vacuum created within the fixed dehydrator can be relatively low as the vacuum is not required to suction the white water against the force of gravity. In addition, less power is consumed because the frictional force between the fixed dehydrator and the short wire is small. These factors contribute to lowering not only the initial cost of the equipment but the running cost as well.

Furthermore, because the Short wire 4 of any desired short wire unit and the endless loop 5 of felt can be disengaged by lifting the felt roll 12 with the lifting device LD and raising the forming roll 11 and couch roll 10, it is possible to use only the minimum number of units necessary in accordance with the weight of the paper to be produced, and to easily replace the short wire.

Finally, it should be noted that various changes and modifications will become apparent to those of ordinary skill in the art. All such changes and modifications are seen to be within the true spirit and scope of the invention as defined by the appended claims.

What is claimed is:

1. Apparatus for use in forming multilayered paper, said apparatus comprising: an endless loop of felt; a plurality of short wire units disposed beneath said endless loop of felt and spaced from one another in a direction in which the endless loop travels in the apparatus, each of said short wire units including a short wire, a fixed dehydrator, and a drive roll disposed at a downstream end of the fixed dehydrator and over which drive roll the short wire runs, the fixed dehydrator including a forming shoe having an upper surface over which the short wire runs, at least part of said upper surface being curved; means for ejecting stock onto the short wire of each of said short wire units; guide means for guiding said endless loop of felt into pressing engagement with the curved part of each of the upper surfaces of the forming shoes of the fixed dehydrators such that said endless loop of felt coacts with each of said short wires running over said curved parts to dehydrate the stock ejected onto the short wire units in a downward direction only, said guide means including a respective forming roll disposed within the endless loop of felt across from respective ones of said short wire units and a couch roll in a coacting relation with said drive roll, each said forming roll and said couch roll biasing the endless loop of felt into engagement with the short wire of a respective one of said short wire units, each said forming roll and said couch roll being supported so as to be vertically movable; a felt roll disposed downstream of each of the short wire units having said vertically movable forming and couch rolls, each said felt roll being disposed beneath said endless loop of felt; and a lifting device operatively connected to said felt roll so as to raise said felt roll into engagement with said endless loop of felt and raise said endless loop at a location downstream of the respective short wire unit, said endless loop of felt being movable out of coacting engagement with said respective short wire unit by raising said felt roll with said lifting device and moving said couch and said forming rolls of the respective short wire unit vertically.

2. Apparatus for use in forming multilayered paper as claimed in claim 1, wherein the forming shoe of each of said dehydrators comprises a plurality of blades spaced apart in said direction of travel, said blades having upper surfaces defining said upper surface of the forming shoe.

3. Apparatus for use in forming multilayered paper as claimed in claim 2, wherein each of the dehydrators includes a suction housing supporting said forming shoe, each said suction housing being connected to a vacuum source, whereby a vacuum aids the dehydration of the stock by the blades of each said forming shoe.

* * * * *